US005360496A

United States Patent [19]

Kuhlman et al.

[11] Patent Number: 5,360,496

[45] Date of Patent: Nov. 1, 1994

[54] NICKEL BASE ALLOY FORGED PARTS

[75] Inventors: G. William Kuhlman, Shaker Heights; Richard A. Beaumont, Avon Lake; Daniel F. Carbaugh, Macedonia; David Anderson, Brecksville, all of Ohio; Amiya K. Chakrabarti; Kenneth P. Kinnear, both of Monroeville, Pa.

[73] Assignee: Aluminum Company of America, Pittsburgh, Pa.

[21] Appl. No.: 44,336

[22] Filed: Apr. 7, 1993

Related U.S. Application Data

[63] Continuation-in-part of Ser. No. 750,127, Aug. 26, 1991.

[51] Int. Cl.[5] ..... C22F 1/10

[52] U.S. Cl. ..... 148/677; 72/377; 148/621; 148/624; 148/674; 148/676; 148/409; 148/410; 148/426; 148/427; 148/428; 148/429

[58] Field of Search ..... 148/621, 624, 676, 677, 148/409, 410, 426, 427, 428, 429, 674; 72/377

[56] References Cited

U.S. PATENT DOCUMENTS

| | | | |
|---|---|---|---|
| 2,570,193 | 10/1951 | Bieber et al. | 420/448 |
| 2,621,122 | 12/1952 | Gresham et al. | 420/454 |
| 3,046,108 | 7/1962 | Eiselstein | 420/448 |
| 3,061,426 | 10/1962 | Bieber et al. | 420/448 |
| 3,166,412 | 1/1965 | Bieber | 420/447 |
| 3,322,534 | 5/1967 | Ker Shaw et al. | 420/448 |
| 3,343,950 | 9/1967 | Richards et al. | 420/448 |
| 3,575,734 | 4/1971 | Muzyka et al. | 148/556 |
| 3,576,681 | 4/1971 | Barker et al. | 148/410 |
| 4,207,098 | 6/1980 | Shaw | 420/443 |
| 4,336,312 | 6/1982 | Clark et al. | 428/680 |
| 4,612,062 | 9/1986 | Nazmy et al. | 148/501 |
| 4,624,716 | 11/1986 | Noel et al. | 148/514 |
| 4,769,087 | 9/1988 | Genereux et al. | 148/677 |
| 4,793,868 | 12/1988 | Chang | 148/677 |
| 4,820,356 | 4/1989 | Blackburn et al. | 148/675 |
| 4,825,522 | 5/1989 | Iwai et al. | 29/889.2 |
| 4,917,738 | 4/1990 | Takano et al. | 148/325 |
| 4,957,567 | 9/1990 | Krueger et al. | 148/676 |
| 4,981,644 | 1/1991 | Chang | 420/442 |
| 5,059,257 | 10/1991 | Wanner et al. | 148/607 |
| 5,080,727 | 1/1992 | Aihara et al. | 148/648 |
| 5,087,305 | 2/1992 | Chang | 148/410 |
| 5,120,373 | 6/1992 | Miller et al. | 148/564 |
| 5,131,961 | 7/1992 | Sato et al. | 148/677 |

OTHER PUBLICATIONS

Howard E. Boyer and Timothy L. Gall, eds.; Metals Handbook Desk Edition; American Society for Metals, Metals Park, Ohio (1985); pp. 24–27 to 24–29.

*Primary Examiner*—Richard O. Dean
*Assistant Examiner*—Robert R. Koehler
*Attorney, Agent, or Firm*—David W. Pearce-Smith

[57] ABSTRACT

Disclosed is a large alloy forging and method for making it. The forging having an alloy composition selected from one of a nickel base alloy, a cobalt-chromium-nickel base alloy, a nickel-cobalt base alloy and an iron-nickel-chromium-molybdenum alloy and having a grain size of ASTM grain size 4 or finer, as measured by ASTM method E112 and having a tensile strength in the range of 135 to 175 KSI. The process includes: (1) four upset forgings, (2) a rapid cooling after the final upset cooling, (3) a first and second upset forging with a reduction greater than 50%, (4) a third upset forging with a reduction greater than 25.%, and (5) a forging process with a fourth upset forging with a reduction greater than 50%.

15 Claims, 1 Drawing Sheet

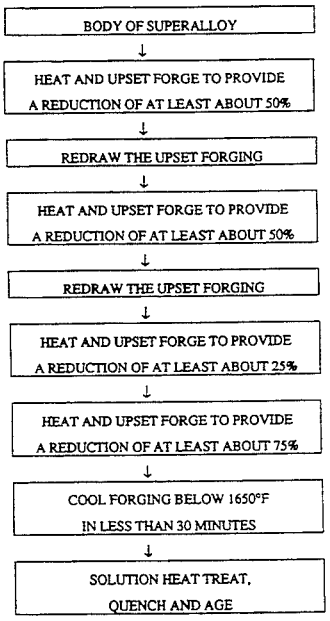

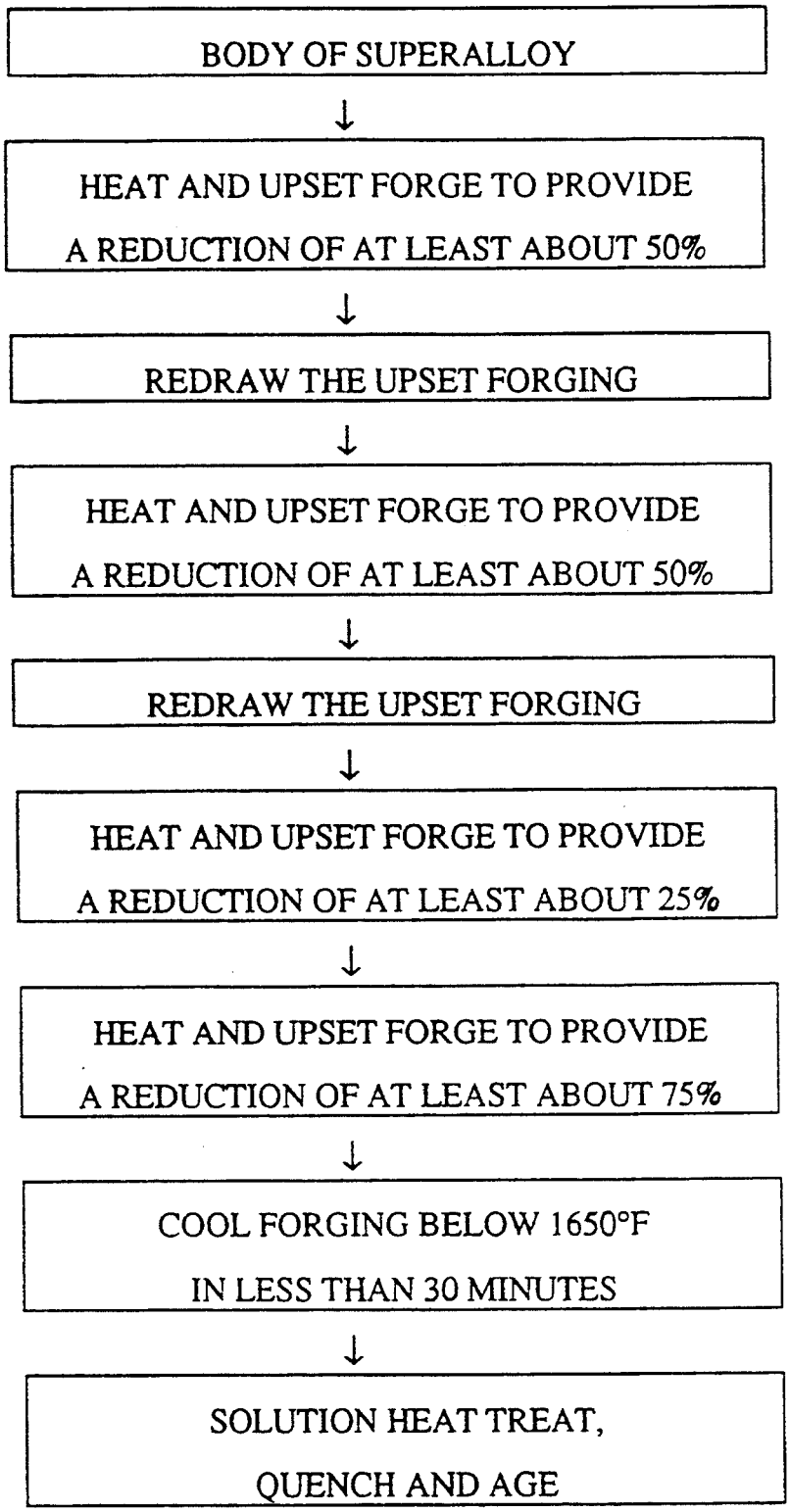
BODY OF SUPERALLOY
HEAT AND UPSET FORGE TO PROVIDE A REDUCTION OF AT LEAST ABOUT 50%
REDRAW THE UPSET FORGING
HEAT AND UPSET FORGE TO PROVIDE A REDUCTION OF AT LEAST ABOUT 50%
REDRAW THE UPSET FORGING
HEAT AND UPSET FORGE TO PROVIDE A REDUCTION OF AT LEAST ABOUT 25%
HEAT AND UPSET FORGE TO PROVIDE A REDUCTION OF AT LEAST ABOUT 75%
COOL FORGING BELOW 1650°F IN LESS THAN 30 MINUTES
SOLUTION HEAT TREAT, QUENCH AND AGE

NICKEL BASE ALLOY FORGED PARTS

CROSS REFERENCE TO RELATED APPLICATION

This is a continuation-in-part application of copending U.S. Ser. No. 07/750,127 filed on Aug. 26, 1991.

FIELD OF THE INVENTION

This invention relates to forged parts fabricated from alloys such as nickel-base alloys, and more particularly, it relates to large forged parts having fine grain size fabricated from nickel-base alloys.

BACKGROUND OF THE INVENTION

It is well known that nickel based superalloys are extensively employed in high performance environments. Such alloys have been used extensively in jet engines and in gas turbines where they must retain high strength another desirable physical properties at elevated temperature of a 100° F. or more.

The following U.S. Patents disclose various nickel-base alloy compositions: U.S. Pat. No. 2,570,193, 2,621,122, 3,046,108, 3,061,426, 3,151,881, 3,166,412, 3,322,534, 3,343,950, 3,575,734, 3,576,681, 4,207,098, and 4,336,312. Despite the number of patents concerning nickel-based alloys, it is still not possible for workers in the art to predict with any degree of accuracy the physical and mechanical properties that will be displayed by these alloys when they are processed using heat treatments and forging practices different from those previously employed.

In addition, nickel-base alloys have been found to be difficult to fabricate, particularly into large forged parts, and consistently obtain fine grain size which aids in achieving mechanical properties in the forged parts.

U.S. Pat. No. 4,793,868 discloses a method for reducing fatigue crack growth in nickel base superalloys. The method involves the step of forming a part to near net shape by forging of by other forming technique. The part is then heat treated to develop regular grains by recrystallization. The part is then deformed by at least 15% to achieve a desired net shape.

Copending U.S. Ser. No. 07/750,127 discloses a process for fabricating recrystallized forged parts from nickel based alloys. The process includes heating the part to a temperature above the recrystallization temperature of the alloy and subjecting the part to a first upset forging operation to provide a reduction in the original length of the body followed by redrawing. The forged body is then subjected to a recrystallization treatment and upset forged a second time wherein its length is reduced at least 25%. Afterwards, the forged body is subjected to another recrystallization treatment and a third upset forging step which provides a reduction in length of at least 75% followed by recrystallization and solution heat treating, quenching and aging. The resulting forged parts having an ASTM grain size of 3 or finer as measured by ASTM E112 Intercept method and a yield strength in the range of 135 to 175 KSI.

Accordingly, it would be advantageous to provide an economical and effective process for achieving fine grain size and improved mechanical properties in large forged parts fabricated from superalloys such as nickel alloys, iron-nickel, nickel-cobalt and cobalt-base alloys and the like without the need for multiple recrystallization treatments.

OBJECTS OF THE INVENTION

It is a primary object of the present invention to provide a process for creating large forged parts fabricated from superalloys such as nickel alloys, iron-nickel, nickel-cobalt and cobalt-base alloys and the like without the need for multiple recrystallization treatments.

Another object of the present invention is to provide a process for creating large forged parts fabricated from superalloys such as nickel alloys, iron-nickel, nickel-cobalt and cobalt-base alloys having a grain size of ASTM 4 of finer.

Still another object of the present invention is to provide a process for creating large forged parts fabricated from superalloys such as nickel alloys, iron-nickel, nickel-cobalt and cobalt-base alloys having a grain size of ASTM 4 of finer without the need for multiple recrystallization treatments.

It is a further object of this invention to provide large forged parts from such alloys having improved mechanical properties.

It is a further object of this invention to provide large forged parts from such alloys having uniformly fine grain size.

It is yet another object of this invention to provide large forged parts from iron-nickel-base alloys and the like having grain size of ASTM grain size 4 or finer as measured by ASTM method E 112, Heyn Intercept Method, and being substantially uniform throughout the forged part.

It is still a further object of this invention to provide the forging from such alloys, the forging having enhanced ultrasonic transmission characteristics of at least 15 to 20% reduction in signal attenuation of an ultrasonic signal operating at a frequency of 2.25 MHZ and by at least a 15 to 20% improvement in return frequency of the same signal operating at 2.0 to 2.25 MHZ.

These and other objects and advantages of the present invention will be more fully understood and appreciated with reference to the following description.

SUMMARY OF THE INVENTION

In accordance with these objects, there is provided a process for fabricating recrystallized, large forged parts having fine grain size and improved tensile properties by providing a body of an alloy selected from one of a nickel-base alloy, an iron-nickel-chromium-molybdenum alloy, cobalt-chromium-nickel alloy, nickel-cobalt and cobalt base alloy. The body is heated to a temperature above the recrystallization temperature of the alloy. The body is then subjected to a first upset forging operation to provide a reduction of at least 50% of the original length of the body. After the first upset forging the body is drawn, subjected to a second upset forging of at least 50% of the original length of the body and drawn again. Thereafter, the second upset forged body is reheated a temperature above the recrystallization temperature of the alloy and subjected to a third upset forging operation to provide a reduction of at least 25% of the original length of the body. The body is heated and maintained above the recrystallization temperature while subjecting it to a forth upset forging operation to provide a reduction in the length of at least 75% of the original length of the third upset forged body. Afterwards the body is cooled to a temperature below 1850° F. in less than 40 minutes. The body is then solution heat treated, quenched and aged.

BRIEF DESCRIPTION OF THE DRAWING

Other features of the present invention will be further described or rendered obvious in the following related description of the preferred embodiment which is to be considered together with the accompanying drawing wherein:

The FIG. 1 is a process flow chart of the method of the present invention.

DETAILED DESCRIPTION OF THE PREFERRED EMBODIMENTS

The term "large forged parts" as used herein is intended to refer to parts weighing from over about 2,000 pounds. Typically, the parts are used to make items which include turbine discs or spacers which can weigh over 5,000 pounds.

The term "fine grain size" as used herein is intended to refer to alloys having an average grain size of ASTM grain size 4 or finer as measured by ASTM method E112, Heyn Intercept Method, and being substantially uniform throughout the forged part.

The term "solution heat treatment" is used herein to mean dissolving at least some of the precipitated inter metallic compounds which have formed in the metal and returns them to solid solution. Preferably, most if not all of the precipitated intermetallic compounds will be returned to solid solution. The specific times and temperatures associated with solution heat treatments depend on the chemical composition and size of the part being treated, most parts formed from aluminum alloys are solution heat treated at a temperature usually in the range of from about 1750° F. (954° C.) to about 1900° F. (1031° C.).

The term "quenching" is used herein to include a rapid cooling of a hot metal object. In general, the object of quenching is to preserve the solid solution formed at a solution heat treatment temperature, by rapid cooling to some lower temperature, usually near room temperature. The temperature change of the piece during quenching is so rapid that the inter metallic compounds, of the type which were dissolved during solution heat treatment, do not have the time to be reprecipitated. The quenching process thus produces a super-saturated metastable solid solution.

The term "aged" as used herein is intended to include both natural aging, which occurs at ambient temperature, and artificial aging which is accomplished by heating the metal to an elevated temperatures which is lower than the solution heat treating temperature. The time needed for artificial aging is much shorter than that required for natural aging.

The term "upset forging" is used herein to refer to a forging process in which the body being forged is hammered or stamped so that its dimension is reduced by at least 25% of its original size.

The term "recrystallized" is used herein to mean that at least 90%, preferably greater than 95%, of the material contains is crystalline.

In accordance with the invention, there is provided a process, as shown in the Figure, for fabricating large forged pans having fine grain size and improved tensile properties. Examples of the forged parts are turbine discs having a thickness of about 11 inches and a diameter of about 72 inches and weighing about 13,000 pounds. Examples of other parts which may be fabricated in accordance with the invention are spacers, about 13 inches thick and 60 inches in diameter, and even larger turbine disc, as high as 21,000 pounds or higher, for example.

Examples of alloys which may be processed in accordance with the invention include the AISI Standard Austenitic stainless steels, the higher-nickel austenitic alloys. the precipitation- hardening stainless steels, the iron-nickel-chromium-molybdenum alloys, the nickel-base alloys, the cobalt-chromium-nickel-base alloys and nickel-cobalt-base alloys, compositions of which are provided in the Metals Handbook, Vol. I, page 467, which compositions are incorporated herein by reference. The iron-nickel-chromium-molybdenum alloys, the nickel-base alloys and the cobalt-chromium-nickel-base alloys, referred to as superalloys, are provided herein for convenience as follows:

TABLE 1

| | Nominal Compositions of Wrought Heat-Resisting Alloys | | | | | | | | | | | | |
|---|---|---|---|---|---|---|---|---|---|---|---|---|---|
| Alloy | C | Mn | Si | Cr | Ni | Co | Mo | W | Cb | Ti | Al | Fe | Other |
| | | | | Iron-Nickel-Chromium-Molybdenum Alloys | | | | | | | | | |
| 19-9 DL | 0.30 | 1.10 | 0.60 | 19 | 9 | — | 1.25 | 1.25 | 0.4 | 0.3 | — | rem | — |
| 17-14 Cu, Mo | 0.12 | 0.75 | 0.50 | 16 | 14 | — | 2.50 | — | 0.4 | 0.3 | — | rem | 3 Cu |
| A-286 | 0.08 | 1.35 | 0.50 | 15 | 26 | — | 1.25 | — | — | 2.0 | 0.25 | rem | 0.3 V |
| Discaloy | 0.06 | 1.00 | 0.70 | 14 | 26 | — | 3.00 | — | — | 1.7 | 0.25 | rem | — |
| 16-25-6 | 0.06 | 1.35 | 0.70 | 16 | 25 | — | 6.00 | — | — | — | — | rem | 0.15 N |
| Incoloy 901 | 0.05 | 0.50 | 0.35 | 13 | 40 | — | 6.00 | — | — | 2.5 | 0.20 | rem | — |
| D-979 | 0.05 | 0.50 | 0.50 | 15 | 45 | — | 4.00 | 4.00 | — | 3.0 | 1.00 | rem | 0.01 B |
| | | | | | Nickel-Base Alloys | | | | | | | | |
| Nimonic 75 | 0.12 | 1 max | 1 max | 20 | rem | — | — | — | — | 0.40 | — | 5 max | — |
| Nimonic 80 | 0.1 max | 1 max | 1 max | 20 | rem | 2 max | — | — | — | 2.25 | 1.25 | 5 max | — |
| Nimonic 80A | 0.1 max | 1 max | 1 max | 20 | rem | 2 max | — | — | — | 2.25 | 1.25 | 5 max | — |
| Nimonic 90 | 0.1 max | 1 max | 1 max | 20 | rem | 18 | — | — | — | 2.50 | 1.50 | 5 max | — |
| M-252 | 0.15 | 0.5 | 0.5 | 19 | rem | 10 | 10 | — | — | 2.50 | 1.00 | 2 | 0.005 B |
| Hastelloy C | 0.15 max | — | — | 16.5 | rem | — | 17 | 4.5 | — | — | — | 6 | — |
| Hastelloy R-235 | 0.15 | — | — | 15.5 | rem | — | 5 | — | — | 2.50 | 2.00 | 10 | — |
| Hastelloy W | 0.12 max | — | — | 5.0 | rem | — | 25 | — | — | — | — | 5.5 | 0.6 max V |
| Hastelloy X | 0.15 | — | — | 22.0 | rem | — | 9 | — | — | — | — | 20 | — |
| Inconel | 0.04 | 0.35 | 0.20 | 15 | 78 | — | — | — | — | — | — | 7 | — |
| Inconel "X" | 0.04 | 0.70 | 0.30 | 15 | 73 | — | — | — | 1 | 2.5 | 0.9 | 7 | — |
| Inconel "X" 550 | 0.04 | 0.70 | 0.40 | 15 | 73 | — | — | — | 1 | 2.3 | 1.2 | 7 | — |
| Inconel 700 | 0.13 | 0.08 | 0.25 | 15 | 45 | 30 | 3 | — | — | 2.8 | 3.2 | 1 | — |
| Waspaloy | 0.1 | — | — | 19 | rem | 14 | 4 | — | — | 3 | 1.3 | 1 | tr B, Zr |
| Udimet 500 | 0.1 | — | — | 19 | rem | 19 | 4 | — | — | 3 | 2.9 | 4 max | tr B |
| Unimet 700 | 0.1 | — | — | 15 | rem | 19 | 5 | — | — | 3.5 | 4.5 | 4 max | 0.03 B |
| Unitemp 1753 | 0.24 | 0.05 | 0.10 | 16 | rem | 7 | 1.5 | 8 | — | 3 | 2 | 9.5 | tr B, Zr |

TABLE 1-continued

| Alloy | C | Mn | Si | Cr | Ni | Co | Mo | W | Cb | Ti | Al | Fe | Other |
|---|---|---|---|---|---|---|---|---|---|---|---|---|---|
| Nominal Compositions of Wrought Heat-Resisting Alloys | | | | | | | | | | | | | |
| Rene 41 | 0.1 | — | — | 19 | rem | 11 | 10 | — | — | 3 | 1.5 | 3 | tr B |
| Cobalt-Chromium-Nickel-Base Alloys | | | | | | | | | | | | | |
| S-816 | 0.40 | 1.2 | 0.4 | 20 | 20 | rem | 4 | 4 | 4 | — | — | 4 | — |
| V-36 | 0.25 | 1.0 | 0.4 | 25 | 20 | rem | 4 | 2 | 2 | — | — | 3 | — |
| L-605, HS-25, WF-11 | 0.15 | 1.5 | 0.5 | 20 | 10 | rem | — | 15 | — | — | — | 2 | — |
| S-590 | 0.40 | 1.2 | 0.4 | 20 | 20 | 20 | 4 | 4 | 4 | — | — | rem | — |
| N-155, HS-95 | 0.15 | 1.5 | 0.5 | 21 | 20 | 20 | 3 | 3 | 1 | — | — | rem | 0.15 N |

INCONEL 718 is an alloy containing 17–21 wt. % Cr, 0.65–1.15 wt. % Ti, 0.20–0.80 wt. % Al, 50–55 wt. % Ni, 2.8–3.3 wt. % Mo, up to 1 wt. % Co, up to 0.08 wt. % C, up to 0.006 wt. % B, up to 0.35 wt. % Mn. up to 0.35 wt. % Si, up to 0.015 wt. % P, up to 0.015 wt. % S, up to 0.30 wt. % Cu, the sum of Nb+Ta being in the range of 4.75 to 5.5 wt. %, the balance being Fe.

Iron-nickel-chromium-molybdenum which may be used can have 10–50 wt. % Ni, 10–25 wt. % Cr, 0–10 wt. % Mo, the balance Fe, and may contain Mn, W, Cb, Nb, Ti, Al up to about 10 wt. %. Representative of such alloys are INCONEL 706, INCONEL 718 and A286.

Nickel-based alloys suitable for use in the invention can have 10–30 wt. % Cr, 0–13 wt. % Co, 0–25 wt. % Mo, the balance nickel with elements such as W, Cb, Nb, Ta, Ti and Al which may be added up to 10 wt. %. Examples of such alloys are INCONEL 625, NIMONIC 90 and NIMONIC 901.

Cobalt-chromium-nickel-based alloys can have 10–30 wt. % Cr, 10–3 wt. % Ni, 1–4 wt. % Mo, 1–15 wt. % W, the balance cobalt, with other elements which may be added up to 10 wt. % are Mn, Cb and Nb. Examples are WASPALOY, UDIMET 700, UDIMET 720 and ASTROLOY.

It will be appreciated that modifications may be made to these alloy compositions and such modifications are contemplated within the purview of this invention.

A body of the alloy is provided as an ingot. Typically, the ingot is about 28 to 38 inches in diameter and about 70 to 120 inches in length. Ingots which axe square or rectangular in cross section may also be used, depending on the end product desired. Ingots of such alloys are often characterized by coarse, equiaxed or columnar as-cast grains which may range from 0.1 to 1 inch or larger in the major dimension. For purposes of nomenclature, the length or height of the ingot is referred to as the A direction, the width is referred to as the B direction and thickness as the C direction. Obviously, in a round or square ingot, the dimensions are the same in the B or C direction.

By fine grain size as used herein is meant ASTM grain size 4 or finer as measured by ASTM E 112 Heyn Intercept Method where the largest dimension of the grain is measured and the grain size is calculated.

Typically, an ingot of the alloy employed is heated from about 50° to 350° F. above its recrystallization temperature. For INCONEL 706, for example, this is about 2000° F. The ingot may be heated to about 2050° F., for example. The ingot should be held at this temperature for a time sufficient to obtain substantially uniform temperature, which time can be as long as 2 to 10 hours and which is suitable for hot working.

After the heat treatment, the ingot is subjected to a first hot upset forging operation which is accomplished by squeezing the ingot to reduce its height or length, i.e., in the A direction. For INCONEL 706, preferably the forging upset is performed while the ingot is maintained in the temperature range of 1700° to 2050° F. The upset forging can be performed in one step so as to impart work to the ingot which reduces its length greater than 40% of its original length, preferably greater than 50% and typically in the range of 50 to 60%. During the forging operation, heated dies may be used to aid maintaining the ingot in the temperature range for purposes of hot working. For example, the dies may be maintained in the temperature range of 600° to 1000° F., typically greater than 800° F. For purposes of the present invention, while reference is made to an ingot, it should be understood that part of an ingot may be used and reference herein to a body is meant to include a tull ingot or part of an ingot or billet.

After the first upset forging, the body is redrawn or reworked. The term "redrawing" as used herein to mean working the upset forged body for example by rolling, drawing or forging. Next the body is subjected to a second upset forging operation similar to the first upset forging operation described above. The body is then redrawn again. Both redrawing steps are performed preferably in the range of 50° to 350° F. below the recrystallization temperature. For INCONEL 706, this temperature is in the range of about ° F. to 2000° F. (927°–1093° C.). The redrawing is provided in an amount which preferably brings the ingot or body back to about its original dimensions. For example, in a round ingot, the redrawing can be sufficient to work the ingot back to about its original diameter. However, it is within the purview of the invention to provide a working amount equivalent to redrawing to the original ingot dimension plus or minus 20% of the original length, for example.

After the second redrawing step, the redrawn body is again heated above the recrystallization temperature, typically in the range of 50° to 250° F. above the alloy's recrystallization temperature, for example 2000° F. for INCONEL 706. The time at temperature can be 2 to 10 hours. The redrawn body is then subjected to a third upset forging operation in the A direction which reduces it at least 25% of its original length, preferably 50 to 70% and typically about 60%. During this forging operation which can be performed in a single step, the body is preferably maintained in a temperature range of 1700° to 2000° F.

The forging dies can be heated, e.g., to 800° F. or above, to aid in maintaining the body at temperature during the third forging operation.

After the third upset forging thermal operation, the body is reheated to a temperature above the recrystallization temperature of the alloy prior to a forth upset forging operation. The heating may be to a temperature about 50° to 100° F. above the recrystallization temperature. For INCONEL 706, preferably this would be in the range of 1900° to 1950° F. For purposes of the forging operation, it is important that the body is maintained at a high temperature, e.g., in the range of 1800° to 1950° F. for INCONEL 706, during forging in order to aid in developing the fine grain size as strain energy is imparted in this temperature range. To aid in maintaining the body at temperature during the forth forging operation, the forging dies can be heated to a temperature range of 1100° to 1400° F. and preferably not less than 1200° F. Further, the body may be insulated to maintain its temperature in the desired range during forging. A suitable insulating material that can be used which does not interfere with the forging operation is fiberglass. The fiberglass can also function as a lubricant. The fiberglass may be covered with a foil in a layered arrangement. Stainless steel foil or similar foil may be used. Thus, the foil-covered insulation may be wrapped around the body and maintained there during the deformation process.

The amount of deformation provided during the forth upset forging is also important. That is, in this step, the amount of work applied is sufficient to reduce the length of the forging by 25 to 80%, preferably sufficient to reduce the length by at least 30% and typically to reduce the length by 40 to 70%.

For purposes of further developing the fine grain structure which is important in the present invention, the forged product is then cooled rapidly to a temperature below about 1600° F. in less than an hour and preferably less than about 1550° F. in less than about 40 minutes. Most preferably the body is cooled to a temperature below about 1400° F. in less than 1 hour.

The thermal inertia of large bodies require special procedures be employed cool the interior of the body within the desired time. These procedures are needed to accelerate the cooling of the entire body. Special cooling procedures include air cooling with devices which circulate cool air over the surface of the body. Thereafter, the forged product may be machined to an appropriate configuration before being solution heat treated, quenched and aged.

The solution heat treatment is performed at a temperature generally about 10°–50° F. above the temperature at which the intermetallic compounds, which have formed in the metal, are dissolved and brought into solid solution. For a forged product produced from INCONEL 706, the solution heat treatment is performed in the range of 1800° to 1900° F. for 4 to 6 hours, quenched in oil and aged by heating to 1350° F. and held for 16 hours. Then the product is cooled at about 100° F./hr to 1150° F. and held for 22 to 30 hours.

This process is particularly useful in producing large forgings, e.g., 5000 pounds or more, having improved mechanical properties. The process imparts a uniform level of deformation strain to the product. Further, the process recrystallizes large as-cast grains and produces a fine grain size, e.g., ASTM grain size 4 or finer. This aids in producing enhanced fatigue and tensile properties and ultrasonic transmission characteristics.

The forged disc provided by the process of the invention is useful as turbine discs and spacers on which the turbine blades are mounted. Typical dimensions for such components are about 60 to 90 inches in diameter and 8 to 15 inches thick. When finish machined, the discs are used in land-based turbines and power generators where temperatures can reach 600° to 1300° F. under loads.

INCONEL 706 forgings produced in accordance with the invention can have an ultimate tensile strength in the range of 170 to 190 KSI, yield strength in the range of 135 to 165 KSI and Charpy Impact Values of 25–45 ft/lb.

The following example further illustrates the present invention.

EXAMPLE 1

Nickel-base alloy INCONEL 706 (composition in wt. %, 41.4 Ni. 16 Cr, 1.7 Ti, 2.9 Cb and Ta and 0.2 Al, the balance Fe) was provided as an ingot 31 inches in diameter and 71 inches in length. The ingot was first heated to 2050° F., which was above the recrystallization temperature, and then worked or upset forged an amount which reduced the length to 35 inches (about 50%) in one step. During the forging operation, the forging dies were maintained at a temperature of about 800° F. The forged body was then redrawn to its original ingot diameter by multiple draw forging steps in the temperature range of 1700° to 2050° F. The redrawn ingot was then upset forged a second time. The conditions of the second upset forging were the same as that of the first upset forging operation. The second upset forged body was then redrawn again to its original shape and reheated to about 1950° F.

Next the second upset forged body was subjected to a third upset forging operation, the ingot was heated to about 2000° F. and then upset forged to reduce the length of the body 50% using dies heated to 800° F. The third upset forged body was redrawn and upset forged for a forth and final time to reduce its length by about 80%.

The forged body was then placed in a furnace at 1950° F. and held for 1 hour after reaching 1950° F. Next the forged body was cooled to 1600° F. in less than 40 minutes. The thermal inertia of the forged body required that active steps be taken to cool the body within the desired time frame. Air was forced over the surface of the body to increase the rate of cooling.

The disc product was rough machined, solution heat treated by heating to 1870° F., oil quenched and aged at 1350° F. for 16 hours. The resulting disc product has an ASTM grain size of 4, ultimate tensile strength of 180 KSI a yield strength of 140 KSI and a Charpy Impact of greater than 40 ft/pounds for tangential grain orientation. The Charpy Impact value at the center of the piece was greater than 20 ft/pounds in the axial direction.

What is believed to be the best mode of the invention has been described above. However, it will be apparent to those skilled in the art that numerous variations of the type described could be made to the present invention without departing from the spirit of the invention. The scope of the present invention is defined by the broad general meaning of the terms in which the claims are expressed.

What is claimed is:

1. A process for fabricating recrystallized large forged parts having fine grain size and improved toughness and tensile properties, the process comprising:

(a) providing a body of an alloy selected from one of a nickel-base alloy, an iron-nickel-chromium-molybdenum alloy, a cobalt-chromium-nickel alloy, a nickel-cobalt alloy and a cobalt-base alloy;

(b) heating said body to a temperature above the recrystallization temperature of the alloy;

(c) subjecting said body to a first upset forging operation to provide a reduction of at least about 50% of the original length of the body:

(d) drawing said body after said first upset forging;

(e) repeating steps (b)-(d) to form a second upset forged body;

(f) reheating said second upset forged body to a temperature above the recrystallization temperature;

(g) subjecting the reheated body to a third upset forging operation to provide a reduction of at least about 25% of the original length of the body;

(h) heating and maintaining said third upset forged body above the recrystallization temperature while subjecting said third upset forged body to a forth upset forging operation to provide a reduction in the length of at least about 75% of the original length of said third upset forged body:

(i) rapidly cooling said forth upset forged body; and (j) solution heat treating, quenching and aging said forth upset forged body.

2. The process in accordance with claim 1 wherein each successive forging operation is performed at a lower temperature than an earlier upset forging operation.

3. The process in accordance with claim 1 wherein in step (b) the body is heated to a temperature in the range of 25° to 250° F. above the recrystallization temperature of the alloy.

4. The process in accordance with claim 1 wherein in step (f) the body is heated to a temperature in the range of 25° to 250° F. above the recrystallization temperature of the alloy.

5. The process in accordance with claim 1 wherein in step (h) the body is heated to a temperature in the range of 25° to 250° F. above the recrystallization temperature of the alloy.

6. The process in accordance with claim 1 wherein the alloy is selected from INCONEL 706, INCONEL 718, INCONEL 625, WASPALOY, UDIMET 700, UDIMET 720, A286, NIMONIC 90, NIMONIC 901 and ASTROLOY.

7. The process in accordance with claim 1 wherein the product, after solution heat treating, quenching and aging, has a grain size of ASTM grain size 4 or finer.

8. The process in accordance with claim 1 wherein the product has an improved ultrasonic transmission characteristic of at least about 20% reduction in signal attenuation at frequencies of 1.5 to 2.5 MHz.

9. The process in accordance with claim 1 wherein the body is substantially circular in cross section.

10. The process in accordance with claim I which further includes forming said forth upset body into a turbine disk or spacer.

11. The process in accordance with claim 1 wherein said forth upset forged body to a temperature below about 1800° F. in less than 30 minutes.

12. The process in accordance with claim 1 wherein said forth upset forged body to a temperature below about 1400° F. in less than 1 hour.

13. The process in accordance with claim 1 wherein in the first upset forging step the body is reduced in length between about 60–70% of its original length.

14. The process in accordance with claim 1 wherein in the third upset forging step the body is reduced in length between about 50–70% of its original length.

15. A process for fabricating a nickel base alloy forged turbine disc or spacer having a fine grain size, the process comprising:

(a) providing a body of a nickel base alloy;

(b) heating said body to a temperature above the recrystallization temperature of said alloy;

(c) subjecting said body to a first upset forging operation to provide a reduction of at least about 50% of the original length of the body;

(d) drawing said body after said first upset forging;

(e) repeating steps (b)-(d) to form a second upset forged body;

(f) reheating said second upset forged body to a temperature above the recrystallization temperature;

(g) subjecting the reheated body to a third upset forging operation to provide a reduction of at least about 25% of the original length of the body:

(h) heating and maintaining said third upset forged body above the recrystallization temperature while subjecting said third upset forged body to a forth upset forging operation to provide a reduction in the length of at least about 75% of the original length of said third upset forged body;

(i) cooling said forth upset forged body to a temperature below 1600° F. in less than 40 minutes; and (j) solution heat treating, quenching and aging said forth upset forged body.

* * * * *